United States Patent [19]

Cronin

[11] Patent Number: 4,493,546

[45] Date of Patent: Jan. 15, 1985

[54] PROCESSING APPARATUS AND METHOD FOR TREATING A FILM UNIT WITH A LIQUID

[75] Inventor: David V. Cronin, Peabody, Mass.

[73] Assignee: Polaroid Corporation, Cambridge, Mass.

[21] Appl. No.: 473,084

[22] Filed: Mar. 7, 1983

[51] Int. Cl.[3] ..... G03D 9/00; G03D 3/02

[52] U.S. Cl. ..... 354/324; 354/328; 354/331

[58] Field of Search ..... 354/304, 303, 307, 315, 354/316, 323, 324, 328, 331, 336, 337

[56] References Cited

U.S. PATENT DOCUMENTS

| | | | |
|---|---|---|---|
| 2,797,625 | 7/1957 | Fairbank | 354/303 |
| 2,873,660 | 2/1959 | Land et al. . | |
| 3,288,609 | 11/1966 | Land et al. . | |
| 3,405,617 | 10/1968 | Land et al. . | |
| 3,405,618 | 10/1968 | Land et al. . | |
| 3,418,912 | 12/1968 | Land et al. . | |
| 3,575,099 | 4/1971 | Levenson et al. | 354/328 |
| 3,659,512 | 5/1972 | Dietz et al. . | |
| 4,121,237 | 10/1978 | Schwartz | 354/328 |
| 4,223,991 | 9/1980 | Brenner . | |
| 4,361,392 | 11/1982 | Hutchison . | |

*Primary Examiner*—A. A. Mathews

*Attorney, Agent, or Firm*—John S. Vale

[57] ABSTRACT

A processing apparatus for immersion treating a sheet-like film unit with a processing liquid is provided with a flexible liquid container having a film unit receiving section and a communicating liquid reservoir section. The container is mounted on a pressure-applying device which is operable to engage the exterior of the container and selectively apply compressive pressure thereto for controlling distribution of a liquid within the container to effect immersion treatment of a film unit in the receiving section and for squeegeeing excess liquid from the treated film unit.

24 Claims, 9 Drawing Figures

PROCESSING APPARATUS AND METHOD FOR TREATING A FILM UNIT WITH A LIQUID

BACKGROUND OF THE INVENTION

The present invention relates to the field of photography and, more specifically, to processing apparatus for treating a sheet-like film unit with a low viscosity processing liquid by effecting immersion of the film unit in the liquid for a desired processing interval and then removing it therefrom.

Immersion treatment of a film unit is used in a variety of photographic processes such as developing, fixing, washing, and combination processes utilizing monobath solutions. While the present invention focuses on treating an exposed self-developing film unit with an aqueous alkaline processing liquid to initiate a developmemt and diffusion transfer process, it will become apparent later that the invention is not limited in its scope to this particular application.

The prior art is replete with processing apparatus for facilitating immersion treatment of a sheet-like film unit. Typically, such apparatus include a container holding a supply of processing liquid; means for locating the film unit at an immersed treatment position within the liquid; and means for squeegeeing excess liquid from the film unit in conjunction with its removal from the container.

One common type of apparatus for processing self-developing film units comprises a liquid holding tray into which the film unit is inserted along guideways to a submerged treatment position, and a pair of pressure-applying rollers between which the wet film unit is advanced for removing it from the tray while at the same time squeegeeing excess fluid therefrom. Some apparatus are configured to process a self-developing film unit embodied as a single sheet laminate structure having both photosensitive and image receiving layers therein. Other processing apparatus are configured to process film units wherein the image receiving layer is on a separate support sheet which is not immersed in the liquid but is fed through the pressure rollers in superposition with a liquid treated photosensitive sheet to form a diffusion transfer film unit. For representative examples of this type of processing apparatus, see commonly assigned U.S. Pat. Nos. 3,288,609; 3,405,617; 3,405,618; 3,418,912; and U.S. Pat. Nos. 4,223,991 and 4,361,392.

Another type of immersion processing apparatus is disclosed in commonly assigned U.S. Pat. Nos. 2,873,660 and 3,255,099; and 3,659,512.

In FIGS. 1–7 of the '660 patent, the apparatus comprises a compressibly deformable, vertically oriented, liquid container having a wiper blade type of squeegee device at its upper film entry end. By applying compressive pressure to the opposite ends of the squeegee device, the interdigitated wiper blades bow out allowing insertion of the film unit into the liquid within the container without interference from the wiper blades. At column 3, lines 68 to 74, it is suggested that the container does not have to be completely filled with the liquid but rather the side walls of the container may be compressed to reconfigure its interior volume and thereby raise the level of the liquid to completely cover that portion of the film unit that is to be immersed for treatment. Following immersion for the prescribed time, the film is manually pulled through the wiper blades to squeegee off excess fluid as the film unit is removed from the container. In other embodiments, shown in FIGS. 8 and 12 through 14, the vertically disposed container is divided into an upper film unit receiving chamber and a lower communicating liquid reservoir. After the film unit is inserted into the upper receiving chamber, the container is inverted to flood the receiving chamber with liquid from the reservoir. Following imbibition, the container is turned upright to drain the liquid back into the reservoir. The wet film unit then is manually pulled through the squeegee device to remove excess fluid.

Commonly assigned U.S. Pat. No. 3,659,512 discloses a self-developing camera having a disposable resilient bladder, holding a supply of processing liquid which is connected to a vertically disposed film treatment chamber. The exposed film unit is inserted into the chamber which is then flooded with the liquid by compressing the bladder (reservior) so it acts as a pump. Following imbibition, the pressure is released and the liquid is drained from the chamber by siphoning action of the bladder.

Immersion processing apparatus known in the prior art have several drawbacks that tend to make them somewhat inconvenient and awkward to use and, in some instances, require construction that is relatively expensive.

For example, in film development applications, many prior art apparatus require the user to handle an aqueous alkaline processing liquid when filling the container with fresh liquid and emptying it of deteriorated liquid, or when changing a disposable liquid container. Because of the caustic nature of the processing liquid, care must be taken to avoid spills or contact with the skin. Also, the user must be familiar with procedures for safely neutralizing the liquid should a spill or skin contact occur.

Another disadvantage is that the squeegee devices (e.g., rollers or wiper blades) act directly on the wet film unit and become coated with the processing liquid. If the processing apparatus is not in continuous use, the liquid tends to dry out and form a residue crust on the squeegee device requiring periodic disassembly and cleaning. Also, a liquid residue can build up on the walls and guide structure of the film unit receiving chamber after the liquid is drained therefrom in processing apparatus that use the receiving chamber/reservoir construction.

Those prior art processing apparatus which employ wiper blades for removing excess liquid from the film unit have a further disadvantage in that the blades apply a shearing force to the outside surfaces of the film unit. In certain types of film units, such a force may abrade or scratch the outer surface or may cause dislocations in interior layers that soften and/or swell upon absorbing the processing liquid.

Certain photographic processing liquids tend to deteriorate as a result of aerial oxidation caused by prolonged atmospheric contact with the liquid in the container. To minimize this problem, some processing apparatus in the art use elaborate and expensive film entry and exit port closures or seals. Other apparatus use liquid surface passivating techniques such as floating a skim coat of mineral oil on top of the processing liquid. While this method may be effective, it is certainly awkward to implement when the fluid has to be changed.

Therefore, it is an object of the present invention to provide a processing apparatus, for immersion treating a film unit with a low viscosity processing liquid, that is convenient and easy to use.

Another object is to provide such a processing apparatus that is relatively inexpensive.

Yet another object is to provide such a processing apparatus which eliminates the need for the user having to fill or empty a liquid container forming part of the processing apparatus.

Still another object is to provide such a processing apparatus wherein components for squeegeeing excess liquid from the film unit do not come into direct contact with the liquid and therefore are not subject to being fouled by dryed out liquid or residue in the liquid.

Another object is to provide such a processing apparatus which includes a liquid container that is easily and inexpensively releasably sealed to minimize atmospheric contact with the liquid in the container.

Yet another object of the invention is to provide such a processing apparatus wherein a film receiving section forming part of the liquid container is adapted to remain in a flooded condition when the apparatus is not in use thereby minimizing contamination of the receiving chamber by dried out fluid or residue products in the liquid.

Other objects of the invention will, in part, be obvious and will, in part, appear hereinafter.

SUMMARY OF THE INVENTION

The present invention provides a low-cost and easy-to-use processing apparatus for immersion treating a sheet-like film unit with a low viscosity processing liquid.

The apparatus includes a liquid container and pressure-applying means acting on the exterior of the container, so as not to come in contact with the liquid, for selectively altering the configuration of the container and to perform a variety of other functions.

The liquid container includes a compliant film unit receiving section and a communicating liquid reservoir section between which a volume of processing liquid, at least sufficient to have such a film unit immersed therein, is selectively distributed to establish a first condition whereby the receiving section is substantially dry and substantially all of the liquid is in the reservior section, and a second condition whereby the receiving section is flooded with liquid from the reservoir section to immersion treat a film unit therein.

The pressure-applying means are configured to act on the exterior of the compliant receiving section for selectively pressing portions of the receiving section against the wet immersion treated film unit therein to squeegee excess liquid from the film unit.

In a preferred embodiment, the pressure-applying means also functions to indirectly exert pressure on the liquid in the receiving section so the liquid flows into the reservior section to change the distribution from the second condition to the first condition.

The liquid container preferably is in the form of a low-cost, flexible plastic bag having an opening at one end through which a film unit is inserted into and withdrawn from the receiving section. The receiving section is separated from the reservoir section by an internal stop member which limits insertion of the film unit to the confines of the receiving section while allowing liquid to flow therearound.

The container is supported on a base member which movably mounts a pressure-applying roller thereon that cooperates with a planar surface on the base member for selectivey applying compressive pressure to the container.

By selectively moving the roller relative to the receiving section the compressive pressure is applied to seal off the receiving section opening; to seal off the reservoir section from the receiving section; to expel air from the receiving section which may tend to impede flow of liquid thereinto from the reservoir section and to compress the receiving section to drive liquid therein back into the reservoir section while simultaneously squeegeeing the immersion treated film unit to remove excess liquid therefrom.

Methods are also presented for immersion treating a sheet-like film unit with such a processing apparatus.

BRIEF DESCRIPTION OF THE DRAWINGS

For a fuller understanding of the nature and objects of the invention, reference may be had to the following detailed description taken in connection with the accompanying drawings wherein.

DESCRIPTION OF THE PREFERRED EMBODIMENT

Figure 1:
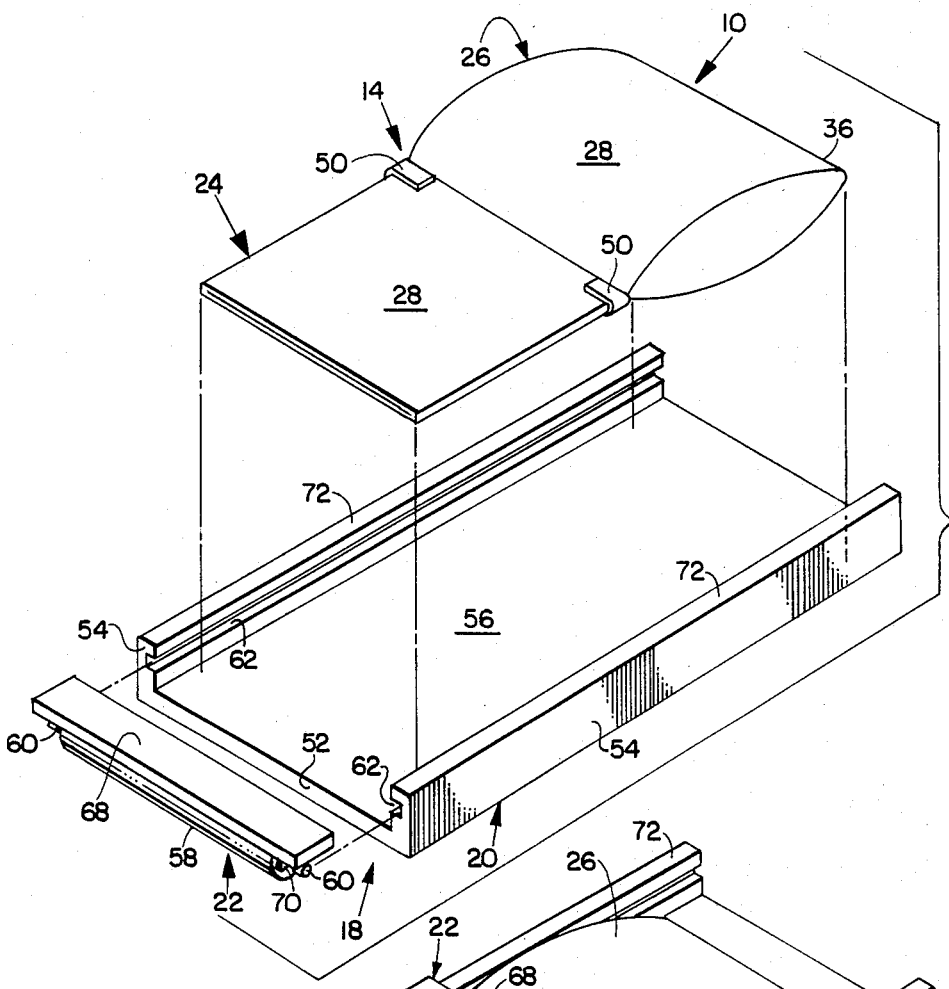
FIG. 1 is perspective view showing, in exploded fashion, the major components of a film processing apparatus embodying the present invention.
Figure 2:
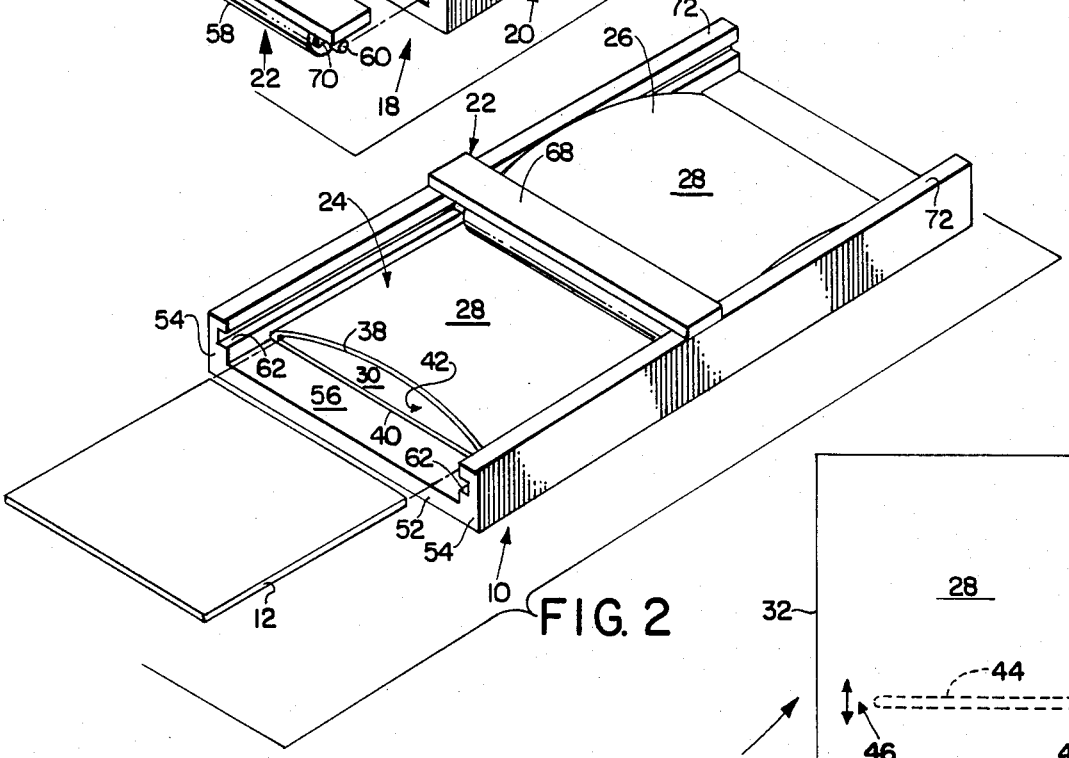
FIG. 2 is a perspective view showing the components of FIG. 1 in their assembled state.

FIGS. 1 and 2 of the drawings show a perspective view of a low-cost and easy-to-use processing apparatus 10 for immersion treating a sheet-like photographic film unit 12 with a low viscosity (similar to water) processing liquid.

In this embodiment, apparatus 10 comprises a compliant or flexible liquid container 14 holding a supply of a low viscosity processing liquid 16 therein (see FIGS. 4 through 8) and a pressure-applying device 18 including a base member 20 for supporting container 14 and a pressure roller assembly 22 which is mounted on member 20 for longitudinal movement relative thereto and cooperates with member 20 for applying compressive pressure to compliant container 14 to selectively change the distribution of liquid 16 therein and to squeegee excess liquid from a film unit 12 following immersion.

Container 14 is preferably prefilled with liquid 16 during manufacture and is provided as a low-cost disposable component of apparatus 10.

After processing a predetermined number of film units 12 (e.g., ten or twenty) in liquid 16, container 14 and the expended liquid 16 therein will be discarded as a unit. As a result of packing the liquid 16 in a disposable container 14, the user avoids direct contact with the liquid thereby minimizing the risk of spills or contact with the skin. This is especially beneficial when the processing liquid 16 is a caustic aqueous solution of an alkaline material or some other type of active photographic chemical.

In the illustrated embodiment, container 14 is a heavy duty, flexible, plastic bag which is divided into a forward, open-ended, film unit receiving section or chamber 24 and a communicating rear liquid reservoir section or chamber 26.

Figure 3:
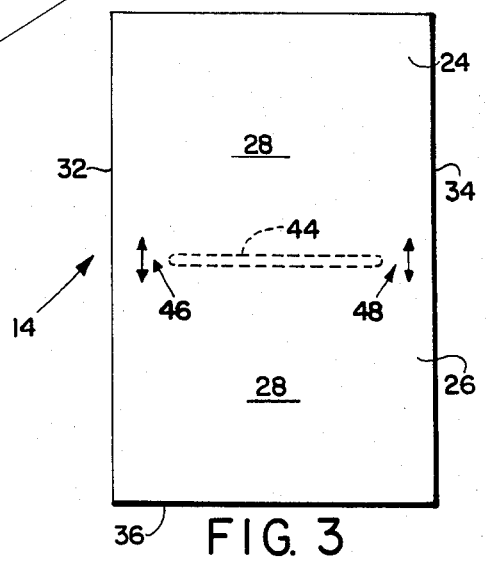
FIG. 3 is a plan view of a flexible liquid container forming part of the apparatus.

As best shown in FIGS. 2 and 3, the bag-like container has a generally rectangular shape and is formed by opposed top and bottom flexible walls 28 and 30, respectively, that are joined or sealed together along three peripheral edges (side edges 32 and 34 and trailing end edge 36). The leading end edges 38 and 40 of walls 28 and 30 are not joined together leaving an access opening 42 at the leading end of container 14 through which a film unit 12 may be inserted into or withdrawn from receiving section 24.

Container 14 includes a laterally extending internal stop member or partial barrier 44 disposed between the receiving and reservoir sections 24 and 26. Stop member 44 joins the interior surfaces of walls 28 and 30 part way across the width of the container leaving two open liquid-flow channels 46 and 48 through which liquid 16 may flow (as indicated by the arrows) between sections 24 and 26. In FIG. 3, channel 46 is disposed between side edge 32 and the left-hand end of stop member 44 while channel 48 is located between side edge 34 and the right-hand end of stop member 44.

Stop member 44 mainly serves as a physical barrier at the trailing end of receiving chamber 24 to prevent insertion of a film unit 12 into container 14 beyond the confines of receiving section 24. If container 14 is made of a thermoplastic sheet material, an inexpensive and practical method of forming stop member 44 is to heat seal the opposed walls 28 and 30 together part way across the width of container 14.

The illustrated construction of a single, centrally disposed, stop member 44 which provides two liquid-flow channels at the sides of the container is not critical to the invention. It is only necessary to provide some type of stop for limiting film insertion while, at the same time, allowing communication between the receiving and reservoir sections for liquid flow therebetween. For example, stop member 44 may comprise a plurality of spaced-apart heat sealed areas arranged in a laterally extending row across the width of container 14 leaving a plurality of liquid-flow channels therebetween.

Because container 14 is to be a disposable item, its material and fabrication costs should be fairly low. This may be accomplished by using any number of readily available and relatiavely inexpensive flexible thermoplastic sheet or tube materials for its construction.

The plastic material should be fairly strong to resist hydrostatic pressures applied to the container when the liquid 16 is subjected to compressive forces to change the distribution of liquid between the receiving and reservoir sections 24 and 26. It is also important that the plastic material be chemically compatible with the liquid 16 so that the plastic is stable and does not lose its strength and flexibility characteristics or chemically interact and contaminate the liquid when the plastic and liquid are in contact for extended periods of time. Another highly desirable material characteristic is that it should be fairly impervious to atmospheric gasses and liquid vapor to prevent liquid loss by evaporation and penetration of the container by atmospheric gasses such as oxygen and carbon dioxide which tend to contaminate or cause deterioration of the liquid.

For the purposes of illustration, it will be assumed that film unit 12 is an integral type of self-developing film unit including in its single sheet multilayer structure one or more photosensitive layers and an image-receiving layer. Following exposure to record a latent image in the photosensitive layer (or layers) the film unit 12 will be processed by immersing it in an aqueous alkaline processing liquid for a specified processing interval to initiate development or diffusion transfer process. For a representative example of such a black-and-white film unit that is treated with an aqueous alkaline processing liquid which may include a silver halide developer, see commonly assigned U.S. Pat. No. 3,578,450. For a representative example of a multilayer structure of a color self-developing film unit wherein an aqueous alkaline processing liquid reacts with dye developers in the film structure, see commonly assigned U.S. Pat. No. 3,701,656.

One particular material that has been found to be compatible with aqueous alkaline processing liquids and has the other above-noted desirable characteristics is polyvinylchloride (PVC).

A container 14 fabricated from an 8-mil thick PVC sheet has exhibited sufficient strength to withstand the hydrostatic pressures encounted during processing. It is expected that suitable containers 14 may be fabricated from PVC sheet having thickness in the range of six to twenty mils. In certain photographic applications, such as print washing where liquid 16 is water or a mild detergent solution, other compatible plastic materials, such as polyethylene, may be used to form container 14.

The required edge and enclosure seals, and the formation of stop member 44 may be accomplished by thermo or thermocompression bonding (including ultrasonic welding) techniques that are well known in the art of manufacturing flexible disposable containers for holding intravenous fluids used in medical applications.

As noted earlier, container 14 is preferably prefilled with liquid 16 during manufacture. The volume of liquid 16 provided substantially fills the reservoir section 26 leaving film receiving section 24 dry. As best shown in FIG. 1, slidably removable compressive pressure clamps 50 are provided on the exterior of container 16 for temporarily sealing off the liquid flow passageways 46 and 48 to prevent leakage from reservoir section 26 during storage and shipment.

Base member 20 of pressure-applying device 18 is adapted to rest on a horizontal work surface such as a table or desk top. It includes a substantially planar, rectangular, bottom wall 52 having a pair of integrally formed, upstanding, longitudinally extending roller guide rails 54 disposed along its lateral sides. The upper surface 56 of wall 52 is dimensioned to have container 14 supported thereon so it nestles between the guide rails 54 as shown in FIG. 2.

The roller assembly 22 includes a cylindrical roller 58 having an axial shaft 60 that extends outwardly beyond the opposite ends of roller 58. In the illustrated embodiment, roller 58 includes a steel core and an outer rubber sheath which is soft enough so it will not abrade the plastic container 14 while providing good traction to establish rolling friction contact with the exterior wall 28 thereof.

The opposite ends of shaft 60 are received in corresponding longitudinally extending guide channels 62 in the guide rails 54. A laterally extending roller handle 68 is coupled to the protruding shaft ends by a pair of depending shaft bearing brackets 70 secured to the underside of handle 68. As best shown in FIG. 2, when roller assembly 22 is coupled to base member 20, the lateral ends of handle 68, which extend outwardly beyond the bearing brackets 70, rest on corresponding top horizontal support surfaces 72 of the guide rails 54 for sliding movement therealong.

When assembly 22 is mounted on base member 20, the height of roller 58 is set with respect to the oppositely disposed support surface 56 such that the roller 58 and surface 56 cooperate to apply a compressive force to the exterior walls of receiving section 24 of container 14 supported on surface 56.

In operation, a new container 14 having a supply of fresh liquid 16 therein is held over support surface 56 so that the forward portion of receiving section 24 having end opening 42 therein, lies flat on the leading end of surface 56 with the bottom wall 30 of container 14 in contact therewith. The roller assembly 22 is moved rearwardly a short distance (to the right as viewed in FIG. 4) so it rides up over the top wall 28. Thus, roller 58 and surface 56 cooperate to provide a compressive force on the leading end of container 14. When compressively loaded in this manner, the interior surfaces of walls 28 and 30 are pressed together sufficiently to provide a liquid-tight seal at the leading end opening 42. Now, because the leading end of container 14 is sealed off, the compressive clamps 50 may be removed from the edges of container 14 allowing liquid 16 to flow through channels 46 and 48 from reservoir section 26 into the film unit receiving section 22.

With the reservoir section 26 resting on support surface 56, the user may flood the receiving section 24 by applying a compressive force to compliant reservoir section 26 to reduce its interior volume and thereby force liquid to flow through channels 46 and 48 into receiving section 22. The user may induce such flow by pressing down on the flexible top wall 28 of reservoir section 26 with the palm of his hand. Such externally applied pressure is diagrammatically illustrated in FIG. 4 by an arrow labeled P. Thus, with surface 56 supporting the opposite side of reservoir section 26 in opposition to force P, compressive pressure is applied to the compliant or flexible reservoir section 26 establishing a pressure differential between the reservoir section 26 and the film unit receiving section 24 which causes a portion of liquid 16 to flow into and flood receiving section 24. In the illustrated embodiment, it takes about one half of the initial total volume of liquid in reservoir section 16 to flood receiving section 24 to provide enough liquid 16 therein for immersion treating a film unit 12.

The apparatus 10 is now in a ready condition for processing a sheet-like film unit 12. It will be noted, that in this ready condition, both film unit receiving section 24 and the reservoir section 26 are flooded keeping their interior surfaces in a wet condition to prevent the accumulation of dried out liquid residue thereon.

Figure 5:
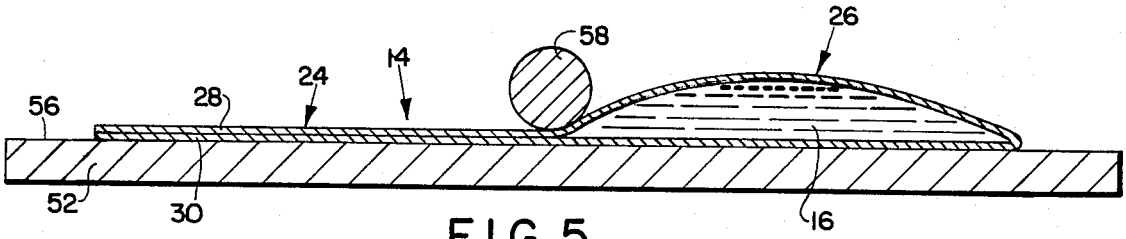

To process a film unit 12, the roller assembly 22 is moved further to the right, as shown in FIG. 5, until it reaches the trailing end of the film unit receiving section 24. During such movement, roller 58 cooperates with the oppositely disposed support surface 56 to progressively apply a compressive pressure to receiving section 24 and thereby force the liquid therein to flow through channels 46 and 48 into the reservoir section 26. The compressive pressure is sufficient in this case to squeegee the liquid out of receiving section 24 as the roller assembly progresses along its length thereby leaving receiving section 24 in a substantially dry first condition. Also, when the roller assembly 22 is in the position shown in FIG. 5 sufficient compressive pressure is applied to container 14 to temporarily seal off the liquid flow channels 46 and 48 and prevent leakage of liquid into receiving section 24.

Figure 6:
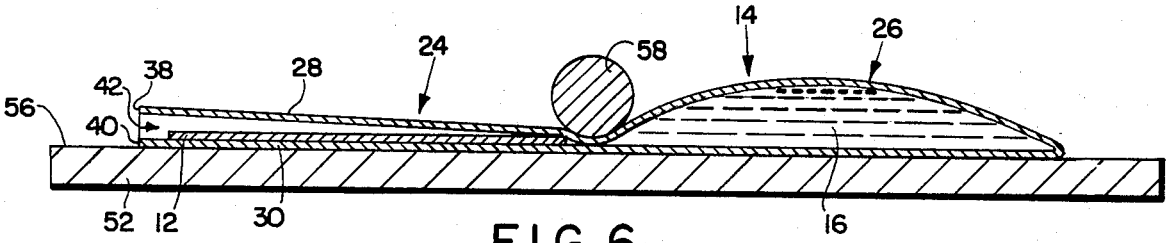
Figure 7:
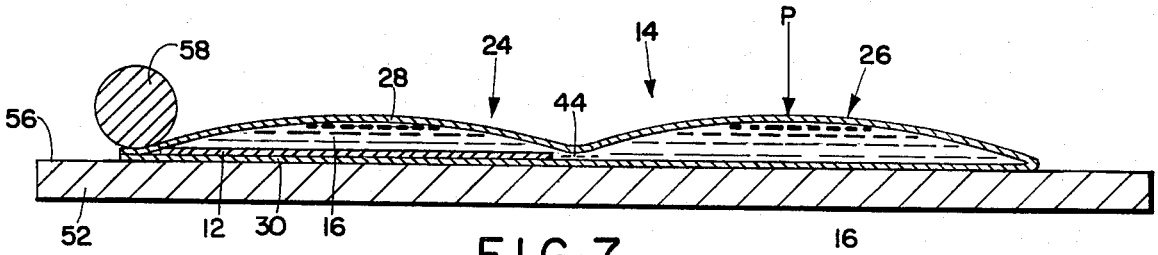

Now, as best shown in FIG. 6, the leading end of the receiving section 24 may be manually opened to insert a sheet-like film unit 12 into receiving section 24 through the leading end opening 42.

Roller assembly 22 is now moved to the left, back to its initial position shown in FIG. 7 where it once again compressively seals the open end of receiving section 24. During such movement, the compressive force progressively applied along the length of receiving section 24 presses the flexible walls 28 and 30 into contact with the film unit 12 to minimize the interior volume of section 24 and thereby expel air out of section 24 through the end opening 42. This minimizes the occurence of trapped air pockets in receiving section 24 which would tend to impede the flow of liquid 16 thereinto from reservoir section 26. The user then once again presses down on the top wall 28 of reservoir section 26 to decrease its interior volume and thereby force liquid 16 through the flow channels 46 and 48 into the film unit receiving section 24. In this manner, a second condition is established whereby receiving section 24 is flooded with liquid 16 for immersion treating the film unit 12 therein.

Figure 8:
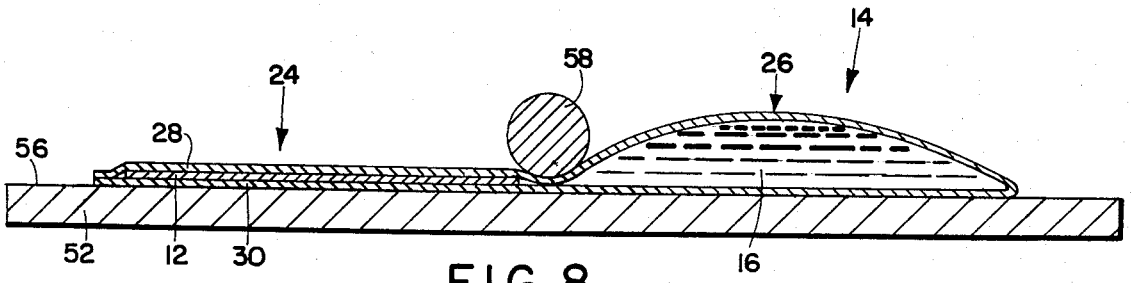

After a specified processing time, determined by the characteristics of film unit 12 and processing liquid 16, allowing sufficient liquid 16 to be absorbed by the film unit 12 to carry out the development and diffusion transfer process, roller assembly 22 is moved back over the receiving section 24 to force the liquid 16 therefrom back into the reservoir section 26 as shown in FIG. 8. During such movement, the roller 58, in cooperation with surface 56, progressively applies a compressive pressure to the flexible top and bottom walls 28 and 32 and presses them against film unit 12 thereby squeegeeing excess liquid from the treated film unit 12. Thus, receiving section 24 is left in a relatively dry state and, with the flow channels 46 and 48 temporarily sealed off, the leading end of receiving section 24 may be opened to remove the treated film unit 12 through end opening 42. After squeegeeing, the film unit is substantially dry to the touch thereby minimizing the risk of the user having skin contact with liquid 16.

Figure 4:
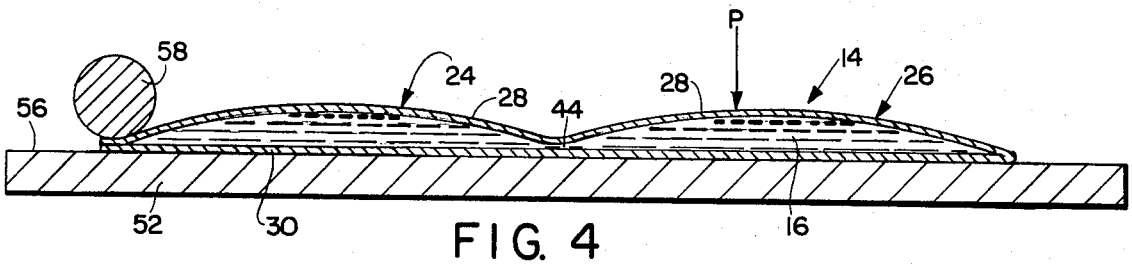
FIGS. 4 through 8 are longitudinal cross-sectional views of the apparatus showing the sequential steps in its operation.

Following removal of the film unit 12, the roller assembly 22 is moved back to its initial position shown in FIG. 4 sealing off the end of receiving section 24 and the pressure indicated by arrow P is applied to the reservoir section 26 to once again flood receiving section 24. As noted earlier, it is preferable to leave receiving section 24 in a flooded condition when the apparatus 10 is not in use, to prevent any small amounts of residual fluid therein from drying out and contaminating interior surfaces of receiving section 24 that will come in contact with the next film unit 12 to be processed.

The pressure-applying means, in the form of a single roller assembly 22 and the opposed support surface 56, engage and act on the exterior of compliant container 14 to indirectly apply, through flexible walls 28 and 30, the compressive pressure to the wet film unit 12 for the purpose of squeegeeing excess liquid therefrom. By means of this construction, the pressure-applying components do not come in direct contact with the liquid 16, or the liquid-soaked film unit 12, precluding fouling of the pressure-applying components by dried out liquid residue thereon.

It should be noted that the pressure-applying means, while simple in their construction, cooperate with the inexpensive compliant container 14 to perform a plurality of functions. Initially, the pressure-applying means provides a temporary liquid-tight seal at opening 42 so that the receiving section 24 may be flooded to assume the ready or initial condition. Next, the pressure-applying means function to selectively compress the receiving section 24 thereby reducing its internal volume to drive the liquid 16 back into the reservoir section 26. Thus, the pressure-applying means engage the container 14 and selectively reconfigure its interior volume to establish a first configuration wherein the receiving section is substantially dry. Upon clearing receiving section 24 of liquid 16, the pressure-applying means act to compressively clamp or close off the liquid flow passageways 46 and 48 to prevent back leakage of liquid from reservoir section 26. After film unit 12 is inserted into receiving section 24, the pressure-applying means function to progressively minimize the volume of receiving section 24 in the direction of opening 42 thereby expelling air therefrom which enters when receiving section 24 is open to receive the film unit 12. The expulsion of the air from receiving section 24 is important because it minimizes the chance of forming an air pocket therein which would tend to impede the flow of liquid 16 into receiving section 24. When returned to the initial position shown in FIG. 7, the pressure-applying means once again seals opening 42 in preparation for flooding receiving section 24. Movement of the pressure-applying means back to the position of FIG. 8 serves both to drive liquid 16 out of receiving chamber 24 and simultaneously squeegee excess fluid from the immersion-treated film unit.

Figure 9:
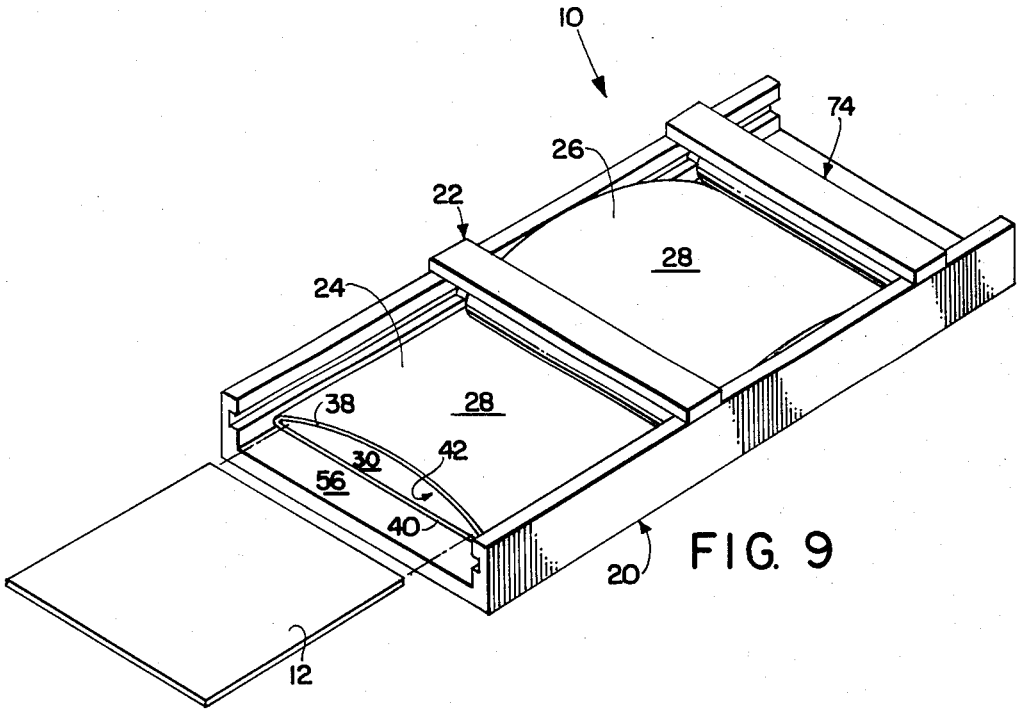
FIG. 9 is a perspective view of an alternative embodiment of the processing apparatus incorporating the present invention.

In an alternative perferred embodiment shown in FIG. 9, apparatus 10 further includes a second pressure roller assembly 74 mounted on base member 20 behind the reservoir section 26. Instead of the user applying the compressive pressure P to the reservoir section 26 with the palm of his hand to change the distribution of liquid within container 14, the user may operate roller assembly 74 to perform this function. That is, when receiving section 24 is to be flooded, roller assembly 74 is moved forwardly to press on the top flexible wall 28 of reservoir section 26. In this manner, assembly 74 cooperates with surface 56 supporting the underside of reservoir section 26 to apply the compressive pressure P thereto for pumping liquid 16 into receiving section 24.

The illustrated embodiments of apparatus 10 are simple in their construction and are intended for use in a photographic darkroom environment equipped with proper safe light to prevent fogging of the exposed film unit 12.

However, the essential components of apparatus 10 described above may be incorporated into a light-tight enclosure or cabinet for daylight processing. In this instance, the exposed film unit 12 to be processed would be housed in a light-tight cassette that is introduced into a light-sealed entry port in the cabinet. Such an apparatus would include automated mechanisms for transferring the film unit into receiving section 24 and removing it therefrom following immersion treatment. Also other automated mechanisms would be provided for operating the two pressure roller assemblies 22 and 74 in a coordinated manner for carrying out the immersion treatment and squeegeeing process described above.

Since certain other changes may be made in the above-described processing apparatus without departing from the spirit and scope of the invention involved herein, it is intended that all matter contained in the above desciption or shown in the accompanying drawings shall be interpreted as illustrative and not in a limiting sense.

What is claimed is:

1. Processing apparatus for treating a sheet-like film unit with a processing liquid, said apparatus comprising:

a liquid container having a compliant film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein; and pressure-applying means configured to act on the exterior of said compliant receiving section for selectively pressing portions of said receiving section against a wet immersion treated film unit therein to squeegee excess liquid from the film unit, said pressure-applying means also functioning to indirectly exert pressure on the liquid in said receiving section so the liquid flows into said reservoir section to change the distribution from said second condition to said first condition.

2. The processing apparatus of claim 1 wherein at least a portion of said pressure-applying means is mounted for movement relative to said receiving section for progressively pressing successive portions of the receiving section against the wet film unit to effect squeegeeing thereof.

3. The processing apparatus of claim 2 wherein said receiving section includes a pair of opposed flexible walls between which a film unit in said receiving section is located and said pressure-applying means includes at least one pressure-applying roller acting on one of said flexible side walls, and means for applying pressure to the opposite side wall in opposition to the pressure applied by said one roller.

4. The processing apparatus of claim 1 wherein said reservoir section is also compliant and is configured to be subjected to an externally applied compressive pressure to selectively reduce its interior volume thereby causing liquid therein to flow into said receiving section.

5. The processing apparatus of claim 4 further including additional pressure-applying means configured to act on the exterior of said reservoir section.

6. Processing apparatus for treating a sheet-like film unit with a processing liquid, said apparatus comprising:

a liquid container having a compliant film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein, said receiving section having an opening therein through which a film unit is inserted into and withdrawn from said receiving section when said first liquid distribution condition is established rendering said receiving section substantially dry; and pressure-applying means configured to act on the exterior of said compliant receiving section for selectively pressing portions of said receiving section against a wet immersion treated film unit therein to squeegee excess liquid from the film unit, said pressure-applying means also being operable to temporarily seal off said opening to prevent leakage of liquid therethrough when said receiving section is flooded to establish said second liquid distribution condition.

7. The processing apparatus of claim 6 wherein said container includes at least one passageway connecting said receiving and reservoir sections through which the liquid is adapted to flow therebetween and said pressure-applying means is also operable to temporarily seal off said at least one passageway to prevent flow of liquid from said reservoir section to said receiving section when said first liquid distribution condition is established.

8. The processing apparatus of claim 7 wherein said pressure-applying means is also operable to selectively compress said receiving section to expel air therefrom through said opening when said receiving section is substantially dry.

9. The processing apparatus of claim 8 wherein said pressure-applying means includes a pressure-applying member mounted for movement relative to said receiving section and is configured to be moved progressively along the length of said receiving section in a direction toward said opening to effect the expulsion of air from said receiving section.

10. Processing apparatus for treating a sheet-like film unit with a processing liquid, said apparatus comprising:

a liquid container having a compliant film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein, said container being in the form of a flexible plastic bag having an opening at one end thereof providing access to said receiving section for inserting a film unit thereinto and subsequently removing it therefrom, and also includes an internal film unit stop member extending part way across said bag between said receiving and reservoir sections, said stop member serving to limit the path of travel of a film unit into said bag to the confines of said receiving section while permitting the flow of liquid between said receiving and reservoir sections; and pressure-applying means configured to act on the exterior of said compliant receiving section for selectively pressing portions of said receiving section against a wet immersion treated film unit therein to squeegee excess liquid from the film unit.

11. The processing apparatus of claim 10 including a base member for receiving and supporting said container and wherein said pressure-applying means includes a horizontal support surface on said base member on which one side of said container rests, and a pressure-applying roller mounted on said base member for movement relative thereto and which engages the opposite side of the container for cooperating with said support surface to progressively apply a compressive pressure along the length of said receiving section in response to moving said pressure-applying roller.

12. The processing apparatus of claim 11 further including a second movably mounted pressure-applying roller which cooperates with said support surface for selectively applying a compressive pressure to said reservoir section.

13. Processing apparatus for treating a sheet-like film unit with a processing liquid, said apparatus comprising:

a liquid container having a compliant film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein, said container being formed from a flexible thermoplastic material and including at least one heat sealed portion thereof that serves as an internal stop member disposed between said receiving and reservoir sections; and pressure-applying means configured to act on the exterior of said compliant receiving section for selectively pressing portions of said receiving section against a wet immersion treated film unit therein to squeegee excess liquid from the film unit.

14. Processing apparatus for treating a sheet-like film unit with a processing liquid, said apparatus comprising:

a compliant liquid container including an open-ended film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein;

means for supporting said container; and pressure-applying means engageable with the exterior of at least said receiving section and being operable for selectively pressing portions of said receiving section against a wet immersion treated film unit therein to squeegee excess liquid from the film unit, said pressure-applying means also being operable for selectively effecting a temporary liquid-tight seal at said opening to prevent leakage of liquid therethrough when said second condition is established.

15. The processing apparatus of claim 14 wherein said pressure-applying means also functions to drive liquid from said receiving section into said reservior section as said pressure-applying means effects squeegeeing of a film unit.

16. The processing apparatus of claim 15 wherein said pressure-applying means also functions to selectively seal off communication between said receiving and reservoir sections to maintain said receiving section in a substantially dry state.

17. The processing apparatus of claim 16 wherein said pressure-applying means also functions to expel air from said receiving section through said open end.

18. Processing apparatus for treating a sheet-like film unit with a processing liquid, said apparatus comprising:

a compliant liquid container including an open-ended film unit receiving section and a communicating liquid reservoir section between which a volume of processing liquid, at least sufficient to have such a film unit immersed therein, is selectively distributed to establish a first condition whereby said receiving section is substantially dry and substantially all of the liquid is in said reservoir section and a second condition whereby said receiving section is flooded with liquid from said reservoir section to immersion treat such a film unit therein, said container being a flexible plastic bag that has an internal film unit stop member between said receiving and reservoir sections which functions to confine insertion of a film unit into said container to said receiving section while allowing liquid flow therearound between said receiving and reservoir sections;

means for supporting said container; and pressure-applying means engageable with the exterior of at least said receiving section and being operable for selectively pressing portions of said receiving section against a wet immersion treated film unit therein to squeegee excess liquid from the film unit.

19. The processing apparatus of claim 18 wherein said container is formed of a thermoplastic material and said stop member is formed by heat sealing selected portions of said container together.

20. A method of immersion treating a sheet-like film unit with a processing liquid comprising the step of:

providing a liquid container having a compliant film unit receiving section and a communicating reservoir section holding a supply of such a processing fluid;

with the receiving section in a substantially dry condition, inserting such a film unit thereinto;

flooding said receiving section with liquid from said reservoir section to immersion treat the film unit for a desired processing time and thereafter returning the remaining liquid to said reservoir section;

applying a compressive pressure to the exterior of said receiving section to press portions of said receiving section against the wet film unit to thereby squeegee excess liquid from the film unit; and removing the squeegeed film unit from said receiving section.

21. The method of claim 20 wherein the application of said compressive pressure also serves to decrease the internal volume of said receiving section and thereby effect the return of the remaining liquid to said reservoir section.

22. The method of claim 20 wherein said receiving section has an opening and said method further includes the step of applying a compressive pressure to said receiving section to expel air therefrom through said opening.

23. The method of claim 22 further including the step of applying a compressive pressure to said receiving section to selectively effect a liquid-tight seal at said opening.

24. The method of claim 20 wherein said container includes a compliant reservoir section and said method further includes the step of applying a compressive pressure to said reservoir section for selectively reducing its internal volume to effect the flow of liquid into said receiving section from said reservoir section.

* * * * *